US006672478B1

(12) United States Patent
Fox

(10) Patent No.: US 6,672,478 B1
(45) Date of Patent: Jan. 6, 2004

(54) METHOD FOR DISPENSING VISCOUS LIQUIDS FROM DEFORMABLE FLEXIBLE TUBES

(76) Inventor: Edward A. Fox, 900 Adams Crossing, Cincinnati, OH (US) 45202

( * ) Notice: Subject to any disclaimer, the term of this patent is extended or adjusted under 35 U.S.C. 154(b) by 0 days.

(21) Appl. No.: 09/473,834

(22) Filed: Jan. 3, 2000

(51) Int. Cl.[7] ..... B65D 35/32
(52) U.S. Cl. ..... 222/99; 222/1
(58) Field of Search ..... 222/92, 99, 107, 222/1

(56) References Cited

U.S. PATENT DOCUMENTS 4,807,782 A * 2/1989 Meinerding et al. ..... 222/1
5,108,008 A * 4/1992 Ryder ..... 222/99
5,205,438 A * 4/1993 Southard ..... 222/1
5,361,939 A * 11/1994 Robertson, Jr. ..... 222/1

FOREIGN PATENT DOCUMENTS

WO 93/18981 * 3/1993 ..... 222/92

* cited by examiner

*Primary Examiner*—Gene Mancene
*Assistant Examiner*—Melvin Cartagena
(74) *Attorney, Agent, or Firm*—Neal O. Willmann

(57) ABSTRACT

Disclosed herein is a method for dispensing neat and measured quantities of the viscous liquid contents of deformable flexible tubes. The disclosed method entails dispensing a small quantity of the contents until a depleted portion near the crimped end of the tube is created, and then folding the depleted portion toward the open end of the tube and securing the fold with an elastic band stretched to encircle and fit snugly around the folded portion. Dispensing, folding and securing are continued until the entire tube is secured in folds and the tube is nearly devoid of contents.

4 Claims, 2 Drawing Sheets

METHOD FOR DISPENSING VISCOUS LIQUIDS FROM DEFORMABLE FLEXIBLE TUBES

BACKGROUND OF THE INVENTION

The present invention relates to a method for facilitating the dispensing of viscous liquids such as tooth pastes, ointments, creams, glues, greases, sealants, caulking compounds and the like, from collapsible and deformable tubes and containers. More specifically, the disclosed method is a simple and almost effortless method of maintaining the folds in the empty portion of a collapsible tube or container so that all of the contents remain in proximal contact with the opening of the tube and only the same minimal effort need be made to dispense the contents from a nearly empty tube as from a newly opened tube.

DESCRIPTION OF THE PRIOR ART

Difficulty in dispensing viscous products from flexible tubes is common in both household and commercial settings and applications. Flexible metal tubes, commonly used in the past, exhibited annoying roll-up and dispensing problems. More recently, plastic laminate tubes, extruded tubes and molded tubes have added significantly to the prevailing difficulty of achieving complete extraction of contents: These newer tubes have little or no "memory" or the ability to retain a rolled-up or folded position making it difficult and messy to dispense the contents as the product is used from the tube. With the contents somewhat uniformly dispersed throughout a partially-full tube, there is little or no control of either the amount dispensed or the steadiness and uniformity of the rate of dispensing. And while others, infra, have addressed these issues and problems with various methods and devices for facilitating the extraction of viscous liquids from a collapsible tube, there remains a need for a simpler, more inexpensive method for addressing the aforementioned problems.

References to such methods and devices are legion in the patent art. A few of the most relevant patent documents include U.S. Des. Pat. No. 351,961 to Bergamo dated Nov. 1, 1994 for a U-shaped tube clip. U.S. Pat. No. 5,549,221 dated Aug. 27, 1996 to Conlee for what is called an "end-lap retainer" which is a clip with a particular configuration designed to fit snugly over the lapped end of a collapsible tube and thereby facilitate the extraction of nearly all of the contents of said tube. Additionally, U.S. Pat. No. 5,697,139 illustrates and claims a method of retaining a rolled-up configuration for the empty portion of a collapsible tube container with a uniquely constructed U-shaped clip. And most recently, U.S. Pat. No. 5,920,967 dated Jul. 13, 1999 to Souza discloses a squeezing device for a collapsible tube that combines squeezing plates with a coiled portion to accommodate and store the empty and depleted portion of the collapsible tube.

Notwithstanding the cleverness, ingenuity and functionality of the methods and devices presented in the prior art, the method of the present disclosure performs almost all of the functions characterized as desirable in the teachings of those references with a method that is unparalleled in its simplicity and effectiveness. The disclosed method is completely effective, unobtrusive and almost without expense.

The principal object of the present invention is to provide a simple method and apparatus for use with collapsible, fold-up tubes to facilitate the effective, uniform and near total extraction of the contents from said tubes.

It is also an object of the present invention to provide a method employing an apparatus that is readily obtainable, inexpensive and simple enough for any child to use.

It is a further object of the disclosed invention to provide a method and apparatus that takes up essentially no space beyond that of the tube itself and therefore provides no hindrance or excuse against use or storage. When used as intended, the disclosed apparatus can be employed and stored with the tube on any counter-top, in any drawer, in any travel kit or in any tool box. In other words, the disclosed apparatus can be used and stored unobtrusively with the tube.

It will also be appreciated that the disclosed method and apparatus, when used as directed, will provide a means of controlling and effecting a continuous, uniform rate of dispensing for the entire contents of the tube because the un-used portion of the contents is kept near the opening of the tube by the presence of the empty, folded and secured portion of the tube. It will be appreciated that the emptied portion of the tube is first flattened and then progressively and sequentially folded over on itself—not rolled up, advancing in several sequential folds, toward the neck of the tube and its opening. These sequential folds are then retained in the folded position by deployment of the disclosed apparatus: an elastic band.

Dispensing from a "full" remaining portion provides control of the tube so that dispensing from the tube can be immediately started or stopped by modest finger pressure on the folded portion of the tube, said pressure being transmitted to the filled portion of the tube. Considering the criticality of dispensing a uniform bead of caulking compound, for example, and for other products as well, uniformity in size and amount of the dispensed bead is highly desired and can be best controlled only by dispensing from the portion of the tube that is still filled to repletion and firm to the touch.

Elaborating somewhat: pressure on the filled portion of the tube is significantly leveraged by pressing the finger on the restrained folds, allowing the full surface area created by the folds to exert and enhance the pressure and the control of dispensing, Because of the large rectangular surface area presented by the folds, finger force applied to the folded area provides a mechanically leveraged pressure applied to the filled portion of the tube. This is an important aspect to the method of dispensing disclosed herein.

SUMMARY OF THE INVENTION

The foregoing objects of the disclosed invention can be succinctly characterized as follows: This invention relates to a method of dispensing the viscous liquid contents of a flexible tube, having an open end and a crimped end, said method comprising: dispensing the contents of said tube to create a depleted portion of said tube; applying finger pressure to the crimped end of said tube to urge contents from said crimped end to the depleted portion of said tube causing said crimped end to become the depleted portion of said tube; folding the depleted crimped end of said tube upon itself and securing this folded portion of said tube with an elastic band stretched to encompass said folded portion; and continuing to dispense the contents of said tube, folding the depleted portion upon itself and securing said folded portions by encircling with said elastic band until the contents of said tube have been dispensed.

DESCRIPTION OF THE PREFERRED EMBODIMENT

Figure 1:
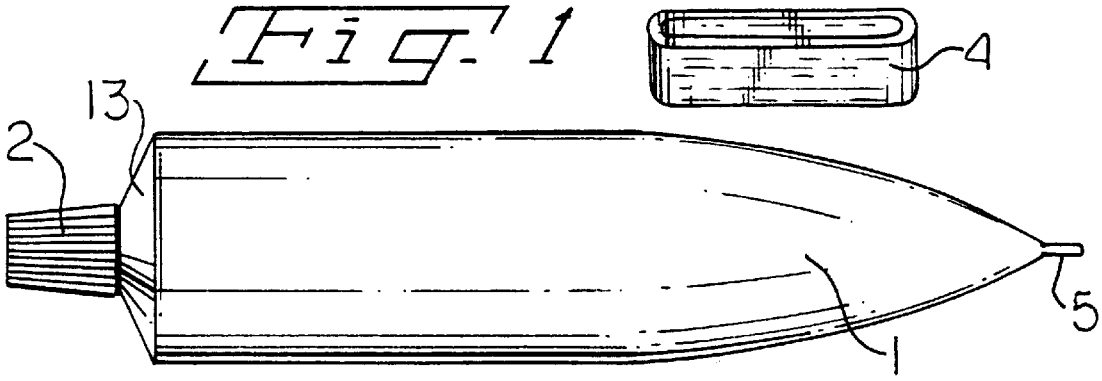
FIG. 1 is a side view of a full tube with band.
Figure 2:
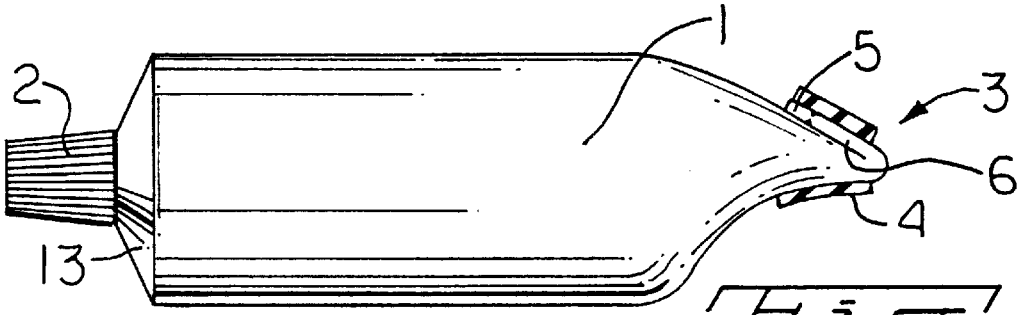
FIG. 2 is a side view, first fold with the band in cross-section.

The disclosed method and the preferred apparatus for use can best be described and understood by reference to the drawing. FIG. 1 clearly depicts a side view of a fill tube 1 with an associated elastic band 4. The tube 1 is further characterized by having a re-sealable cap 2 for enclosing the open end of said tube, a rigid shoulder 13 and a crimp 5 sealing a second end 3 of the tube. FIG. 2 depicts the tube 1 of FIG. 1 with a small amount of the contents dispensed leaving room to initiate a first fold of first depleted section 6. This first fold is secured by the elastic band 4, which has been stretched to encircle the first fold.

Figure 3:
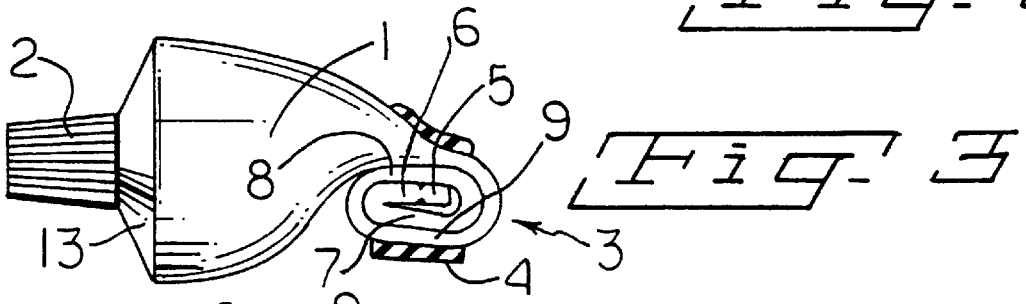
FIG. 3 is a side view, multiple folds with the band in cross-section.

In FIG. 3 the tube of FIGS. 1 and 2 is depicted with multiple folds, including depleted sections of the tube identified as sections 6, 7, 8 and 9. And, again, these multiple folds are secured by the elastic band 4, which has been stretched to encircle said multiple folds.

Figure 4:
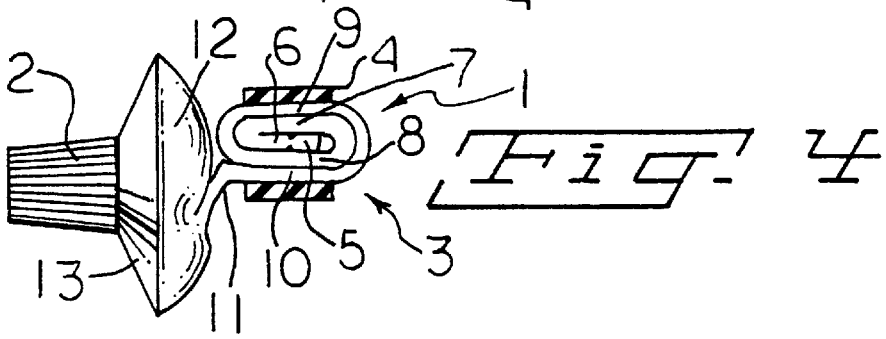
FIG. 4 is a side view, maximum folds with the band in cross-section.
Figure 5:
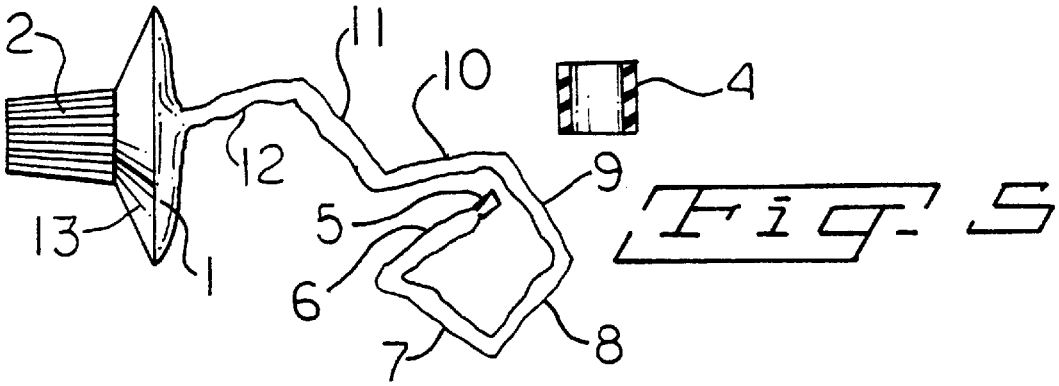
FIG. 5 is a side view, empty tube unfolded and band removed and in cross-section.

FIG. 4 continues to depict the extraction and folding process to the point where the tube has been essentially depleted of contents and folded to its practical limit. In this instance, tube segments 6, 7, 8, 9, 10, and 11 are depicted as depleted, folded and secured with an elastic band 4. FIG. 5 depicts the unfolding of the tub 4 of FIG. 4, as the tube is readied for disposal, when the elastic band may be removed and retained for reuse.

Figure 6:
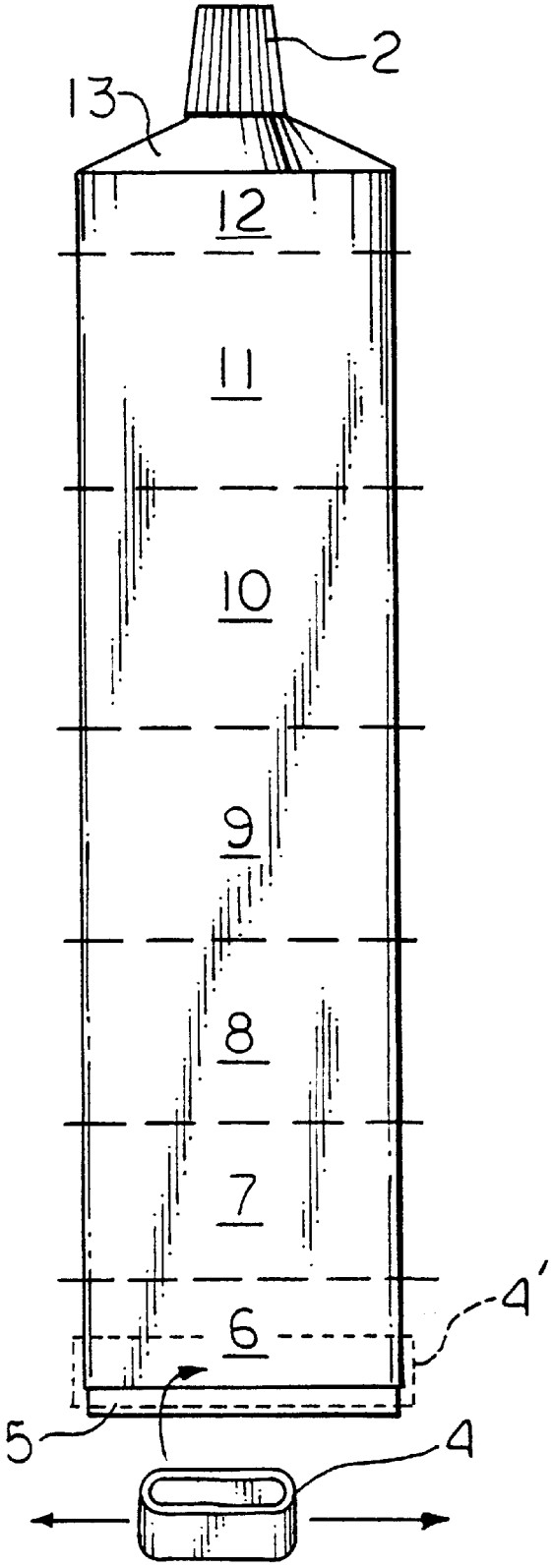
FIG. 6 is a top plan view of empty tube, folds defined; band in perspective and in phantom stretchable to fit any size tube.
Figure 7:
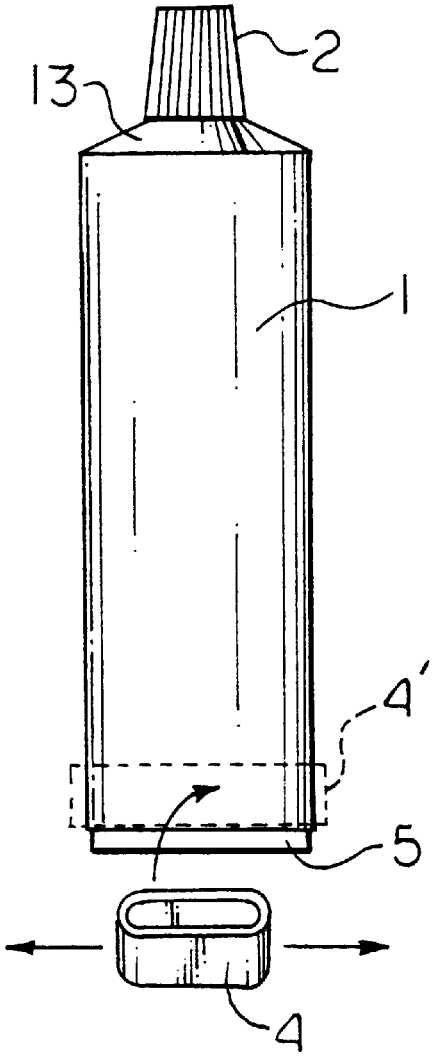
FIG. 7 is a top plan view of smaller-sized full tube; band in perspective and in phantom stretched modestly to fit smaller tube.

FIG. 6 presents a tube 1 and band 4 stretchable to increase in size to accommodate a tube of any reasonable size, and the tube is shown divided into typical folding segments. Needless to say, the size and location of the folding segments is not demarcated and are arbitrarily selected by the user of the tube. FIG. 7 merely illustrates the point that the size of the tube is relatively unimportant and bands 4 can certainly be used to accommodate a wide variety of tubes 1.

In manufacture and distribution, it is intended that the tube be filled by the product manufacturer and sealed, probably by crimping or thermoplastic sealing. At this time, the tube would be provided with an elastic band, typically placed loosely in the carton containing the tube or stretched over the bottom of the tube.

The band will preferably be an endless or continuous elastic band of rubber or similar elastic material. The band should be wide enough to provide sufficient restraint on the folded tube and be easy to remove and re-position as the number of folds increases. The preferred band will be long enough to stretch once around the diameter of the tubes of different sizes and have sufficient elasticity to be to be adequately taut for a variety of tube sizes. While using a longer elastic band would certainly be feasible, wrapping a longer band several times around a tube would tend to defeat the simplicity and convenience of the disclosed method and apparatus.

In use, the elastic band will be re-positioned several times until there is essentially no product remaining in the tube. For instance, all flattened and folded portions 6, 7, 8, 9, 10 and 11 impinge just below the more rigid shoulder 13 of the tube. Finger pressure on the folds at the top portion of the folds held in place by the elastic band 4 provides added leverage in transmitting pressure from the entire folded area to expel the product remaining in the shoulder 13. This added leverage provides an enhanced opportunity for the user to extract as much product as possible, reducing to a very minimum the product hung-up and remaining in the tube.

While the foregoing is a complete and detailed description of the preferred embodiments of the disclosed method and its apparatus for use in dispensing viscous liquids from deformable tubes, numerous variations and modifications may also be employed to implement the all-important purpose of the method and its use without departing from the spirit of the invention; and, therefore, the elaboration provided should not be assumed to limit, in anyway, the scope of the invention, which is fairly defined by the appended claims

What I claim is:

1. A method of dispensing viscous liquid contents from a flexible tube having an open end and a crimped end, said method comprising: dispensing a small amount of the contents of said tube to create a depleted portion of said tube; applying finger pressure to the crimped end of said tube to urge contents from said crimped end to the depleted portion of said tube causing said crimped end to become the depleted portion of said tube; folding the depleted crimped end of said tube upon an undepleted portion of the tube to create a folded portion of said tube and securing said folded portion with an elastic band, separate and distinct from said tube, stretched to encompass said folded portion; and continuing to dispense the contents of said tube by applying finger pressure on said folded portion, removing the elastic band from the folded portion, folding the folded portion upon the newly depleted portion and securing the newly folded portion by reencircling with said elastic band and repeating this sequence until the contents of said tube have been dispensed.

2. A method according to claim 1 wherein the viscous liquid is toothpaste.

3. A method according to claim 1 wherein the elastic band is a rubber band.

4. A method according to claim 1 wherein the flexible tube is plastic.

* * * * *